US006568426B1

(12) United States Patent
Chapman

(10) Patent No.: US 6,568,426 B1
(45) Date of Patent: May 27, 2003

(54) PRESSURIZED WATER SUPPLY SYSTEMS

(75) Inventor: Francis Stanley Chapman, Rayleigh (GB)

(73) Assignee: Gee Group LTD, Essex (GB)

( * ) Notice: Subject to any disclaimer, the term of this patent is extended or adjusted under 35 U.S.C. 154(b) by 0 days.

(21) Appl. No.: 09/701,758

(22) PCT Filed: Jun. 3, 1999

(86) PCT No.: PCT/GB99/01542

§ 371 (c)(1),
(2), (4) Date: Jan. 29, 2001

(87) PCT Pub. No.: WO99/63225

PCT Pub. Date: Dec. 9, 1999

(30) Foreign Application Priority Data

Jun. 4, 1998 (GB) ..... 9811931

(51) Int. Cl.[7] ..... F16L 55/04

(52) U.S. Cl. ..... 137/565.34; 137/565.13; 137/565.16; 137/335; 417/12; 417/44.2

(58) Field of Search ..... 137/899, 335, 137/565.13, 565.34, 565.16, 565.12; 417/44.2, 12

(56) References Cited

U.S. PATENT DOCUMENTS

| | | | | | |
|---|---|---|---|---|---|
| 2,840,101 | A | * | 6/1958 | Saylor | 137/335 |
| 3,111,942 | A | * | 11/1963 | Miller | 137/337 |
| 3,963,375 | A | * | 6/1976 | Curtis | 417/12 |
| 4,290,735 | A | * | 9/1981 | Sulko | 417/12 |
| 4,802,829 | A | * | 2/1989 | Miller | 417/12 |
| 5,277,219 | A | * | 1/1994 | Lund | 417/12 |
| 5,464,327 | A | * | 11/1995 | Horwitz | 417/12 |
| 5,901,744 | A | * | 5/1999 | Richards | 137/202 |

* cited by examiner

*Primary Examiner*—A. Michael Chambers
(74) *Attorney, Agent, or Firm*—Andrus, Sceales, Starke & Sawall, LLP

(57) ABSTRACT

A pump assembly for a pressurized water system includes a pressure sensitive switch (27) arranged to monitor the water pressure in a pipe (14) extending between a water delivery pump (13) and a tap (15), the switch (27) controlling operation of the pump (13) dependent upon pressure in the pipe (14). A timer switch (30) is disposed in series with the pressure sensitive switch (27), to inhibit pump operation other than for a limited period of time following triggering of the timer switch (30).

15 Claims, 1 Drawing Sheet

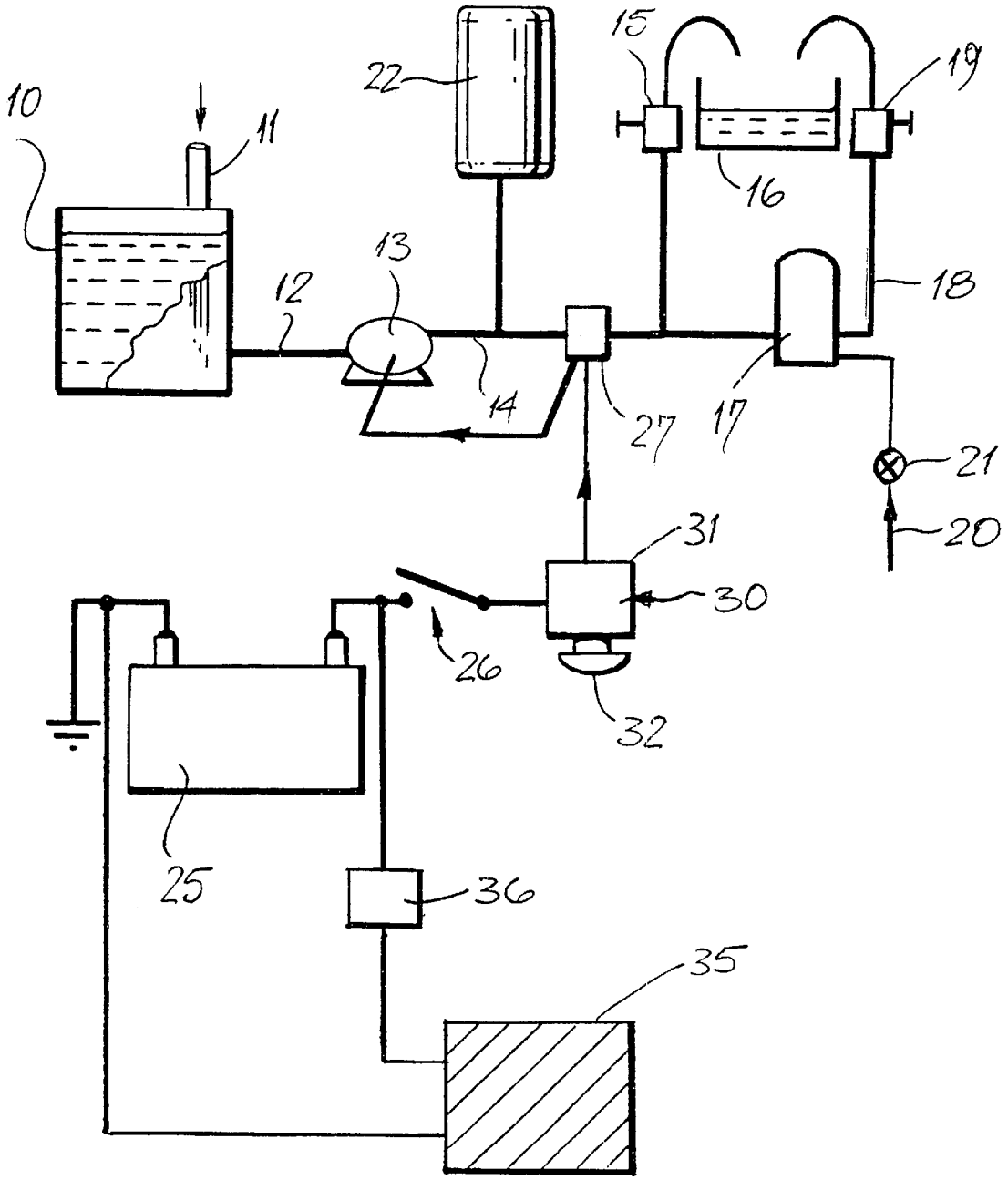
10
11
12
13
14
15
16
17
18
19
20
21
22
25
26
27
30
31
32
35
36

PRESSURIZED WATER SUPPLY SYSTEMS

This invention relates to a pump assembly for use in a pressurised water supply system. The invention further relates to a pressurised water supply system including such a pump assembly.

A known pump-operated water supply system is described in U.S. Pat. No. 5,464,327A. This is intended to maintain pressure in a system at all times following switching on the pump for the first time, and to ensure this result, the pump initially runs for 90 seconds, and thereafter always for a minimum period of 10 seconds. The consumption of electricity and water is not therefore an issue.

By contrast, it is sometimes necessary for a building or other construction site or a remote location to be provided with a fresh water supply system which draws water from a local tank when water is required, the tank being replenished on an occasional basis from some other source. Typically the system employs a pump, powered by a low-voltage electric motor, to draw water from the tank and supply that water under pressure to a tap mounted adjacent a basin provided at some suitable location. An instant heater, powered by bottled gas, may be fitted into the pipe from the pump to the tap, so that the system can deliver hot water. A pressure-sensitive switch is connected into the pipe from the pump to the tap, unless such a switch forms a part of the pump assembly itself, and controls operation of the motor driving the pump. When water is to be drawn, the tap is opened, the pressure in the pipe between the pump and the tap falls so closing the pressure sensitive switch, and current then flows from a battery to the pump motor. Frequently, an accumulator is connected to the pipe between the pump and the tap, in order to smooth out pressure variations and ensure that water is delivered immediately on opening the tap, without having to wait for the pump to start operating. Such an accumulator also allows a small quantity of water to be drawn without the pump starting, each time.

A water supply system as defined above is well-known and very widely used, not only on building and construction sites but also in caravans, motor-homes, boats and so on. It does however have the problem that if there are leakages—and even very minor leakages—downstream of the pump, the pressure in the pipe between the pump and the tap will gradually fall over a period time, and typically hours or even days. The pump will then be caused to operate, even when no water is to be drawn from the tap. This gives rise to a number of disadvantages, as follows:

a) The pump may operate at an unexpected time, such as in the middle of the night. Many designs of low voltage electric motor-driven pumps are somewhat noisy and if the system is installed for example in a caravan, motor-home or boat, the noise easily could wake up persons sleeping.

b) The operation of the pump when not required may impose a considerable and unnecessary drain on the battery powering the pump, so leading to the need to recharge the battery more frequently than otherwise would be required.

c) The tank can hold only a limited quantity of water and over an extended period of time, a minor leakage could amount to a significant proportion of the total held volume. The rate at which water will leak will be dependent upon the pressure in the system downstream of the pump and unnecessary operation of the pump maintains that pressure at a higher value than otherwise would be the case, leading to greater water losses.

The present invention aims at addressing the above problems associated with the known form of pressurised water supply system as described above.

According to the present invention, there is provided a pressurised water supply system for use in a location having no mains water supply, which supply system comprises a water tank, a water outlet tap, a water pump assembly installed in said water pipe and including a low-voltage dc pump motor, a water pipe connecting the tank to the tap, a pressure sensitive switch arranged to monitor the water pressure in the pipe between the pump and the tap and arranged to operate the pump when the switch detects a pressure below a pre-set low value, characterised in that there is provided a manually-triggerable timer disposed adjacent the tap and which timer inhibits operation of the pump despite the pressure sensitive switch detecting low water pressure below said pre-set low value other than during a timed period following manual triggering of the timer.

It will be appreciated that when a pressurised water supply system of this invention is used at, for example, a building or construction site; the interval between recharging a battery dedicated to supplying power to the motor of the pump may be extended by some months. Moreover, water consumption through leakage also is reduced, leading to the need to refill the water tank less frequently.

If the system is to deliver hot water, an instant water heater, powered by bottled gas, may be fitted into the pipe extending between the pump and the tap. In this case a branch pipe upstream of the heater may supply water to a cold tap.

In a preferred form of this invention, the pump comprises a low-voltage dc motor drivingly coupled to a water pump of a known design, such as a diaphragm pump or a centrifugal pump. Typically, the dc motor will be a 12 volt motor, for powering by a conventional 12 volt battery such as a lead-acid accumulator.

The timer which inhibits pump operation could operate on a number of different bases. For example a purely electronic timer could be employed, energised by depressing a switch, and which turns itself off at the end of a pre-set period. In a preferred embodiment, the timer includes a switch for connection in series with the power supply to the electrical pump, and a mechanical timer is coupled to the switch. Such a mechanical timer may comprise a spring-loaded pneumatic dash-pot coupled to a normally-open electrical switch, which switch is closed on depression of the dash-pot against the spring loading. Then, as the dash-pot is driven back to its initial position by the spring loading, the electrical switch will be opened once more so inhibiting pump operation. Rather than a piston and cylinder dash-pot, a flexing diaphragm arrangement may be employed. In either arrangement, the timer preferably is mounted closely adjacent the tap of the overall system, so that before water can be drawn from the tank, the timer must be operated so enabling the pump. If water had been drawn relatively recently, water flow may be expected more or less immediately, whereas if no water had been drawn for some time, then the pressure between the pump and the tap may have fallen such that pump operation must be re-started, before water will flow out of the tap.

In the pressurised water supply system of this invention, an accumulator may be connected to the pipe between the pump and the tap, to smooth out pressure variations, as with known water supply systems of this kind. On the other hand, such an accumulator will increase water wastage in the event that there is a small leak, and so it is preferred that the volume of the accumulator is minimised or that no accumulator at all is provided.

Means may be provided for re-charging a battery associated with the pump. Conveniently, the recharging means may be a solar cell array, able to deliver current to the battery during bright periods.

By way of example only, one specific embodiment of this invention will now be described in detail, reference being made to the accompanying drawing which diagrammatically shows a complete pressurised water supply system arranged in accordance with the invention.

In the drawing, there is shown a water tank 10 which typically is in the form of a closed stainless steel or plastics material tank having a filler inlet 11 and an outlet pipe 12. The outlet pipe is connected to an electric-motor driven pump 13. A pipe 14 is connected to the outlet side of the pump 13 and branches to a tap 15 disposed adjacent a basin 16. The pipe 14 also leads to a gas-powered instant water heater 17 having a hot water outlet pipe 18 connected to a further tap 19 disposed adjacent the basin 16. A gas-supply pipe 20 is connected through a shut off valve 21 to the heater 17.

An accumulator 22, of a known design and typically having a volume of from 1 to 5 liters, is connected to the pipe 14 and is charged whenever the pump 13 is operated. The accumulator allows a small volume of water to be drawn from either tap 15 or 19 without the pump operating.

The pump 13 is powered by a 12 volt dc motor supplied with current from a 12 volt battery 25 through an isolator switch 26 and a pressure sensitive switch 27 connected to the pipe 14, to monitor the pressure of water in that pipe. The pressure sensitive switch 27 is normally closed, but the switch contacts open upon the pressure in pipe 14 reaching a pre-set value. In this way, the motor associated with the pump 13 will operate provided the battery 25 is sufficiently charged, the isolator switch 26 is closed and the pressure in pipe 14 is below the pre-set value.

The water supply system described thus far is entirely conventional and is widely used for example on building and construction sites as well as in boats, caravans and motor-homes. It suffers from the disadvantages discussed above concerning water wastage, unnecessary discharging of the battery 25 and also unwanted noise from operation of the pump, when no water is being drawn. In this embodiment of the invention, a timer switch 30 is connected in series with the isolator switch 26 and the pressure sensitive switch 27, which timer switch 30 includes normally open switch contacts (not shown) within a body 31, which contacts may be closed by depression of a plunger 32 slidably mounted in the body. The plunger 32 is connected to a pneumatic diaphragm-type dash-pot the rate of leakage of air from which may be adjusted to control the time constant of the switch, the plunger 32 being spring-urged to an initial position where the contacts are open. Thus, on depression of the plunger 32, the switch contacts will remain closed for a limited period of time—and typically only 1 or 2 minutes. Thereafter, the switch contacts will remain open until the plunger 32 is depressed once more.

In a practical installation of the water supply system as described above, the timer switch 30 will be mounted closely adjacent the tap 15, so that the plunger 32 may be depressed just before water is required. This will allow operation of the motor associated with the pump 13 to build up pressure in pipe 14 to the required level and maintain it, for so long as water is being drawn. After the pre-set period, the pump will not operate again, irrespective of the pressure in pipe 14, until the plunger is depressed once more.

Optionally, a solar cell array 35 may be arranged to recharge the battery 25 through a regulator 36. Such an array should be mounted externally so as to deliver current to the battery during bright periods. In the alternative, other known systems may be provided for recharging the battery.

It will be appreciated that this embodiment of the invention allows the useful life of the battery between chargings to be extended, as well as minimising wastage of water. In a modified form of the invention (not shown), a second battery may be provided, with isolator switch 26 being in the form of a selector switch, allowing either battery to be connected into the circuit. A warning light may be provided, to indicate when a battery needs recharging, and that the other battery should be brought into operation. Also, the accumulator 22 may be omitted, or have a much reduced volume as compared to known systems, to minimise possible wastage of water during periods when the pump is not operated, should there be a leak or inadequate closing of either tap.

What is claimed is:

1. A pressurized water supply system for use in a location having no mains water supply, which supply system comprises a water tank, a water outlet tap, a water pipe connecting the tank to the tap, a water pump assembly installed in said water pipe and including a low-voltage dc pump motor, and a pressure sensitive switch arranged to monitor the water pressure in the pipe between the pump and the tap and arranged to operate the pump when the switch detects a pressure below a pre-set low value, characterized in that there is provided a manually-triggerable timer disposed adjacent the tap and which timer inhibits operation of the pump despite the pressure sensitive switch detecting low water pressure below said pre-set low value other than during a timed period following manual triggering of the timer, and said timer requiring manual resetting by a user for each subsequent timed period.

2. A pressurised water supply system as claimed in claim 1, wherein the pressure-sensitive switch is mounted on the pump directly to sense the water pressure at the outlet thereof.

3. A pressurised water supply system as claimed in claim 1, wherein the timer comprises a switch connected in series with a power supply to the pump motor and a mechanical timer coupled to the switch.

4. A pressurised water supply system as claimed in claim 3, wherein the mechanical timer comprises a spring-loaded pneumatic dash-pot coupled to a normally-open electrical switch, which switch is closed on depression of the dash-pot against the spring-loading.

5. A pressurised water supply system as claimed in claim 4, wherein the dash-pot is in the form of a flexible diaphragm, deformable by a manually-depressible plunger.

6. A pressurised water supply system as claimed in claim 5, wherein the timer is mounted adjacent the tap for manual triggering when water is to be delivered from the tap.

7. A pressurised water supply system as claimed in claim 5, wherein a water heater is incorporated in said pipe connecting the tank to the tap.

8. A pressurised water supply system as claimed in claim 7, wherein the water heater operates only when water flows out of the tap, instantaneously to heat the water.

9. A pressurised water supply system as claimed in claim 7, wherein the water heater comprises a gas-powered heater which is turned on only when water flows out of the tap.

10. A pressurised water supply system as claimed in claim 7, wherein a second tap for the discharge of non-heated water is connected to said pipe up-stream of the heater.

11. A pressurised water supply system as claimed in claim 1, wherein an accumulator is connected to the said pipe between the pump assembly and the tap.

12. A pressurised water supply system as claimed in claim 1, and including a re-chargeable battery for powering the pump motor.

13. A pressurised water supply system as claimed in claim 12, wherein a solar panel is provided to effect recharging of the battery.

14. A pressurized water supply system as claimed in claim 1, wherein said timer is mounted adjacent the tap for manual triggering when water is to be delivered from the tap.

15. A pressurized water supply system as claimed in claim 1, wherein a gas-powered instantaneous water heater is provided to heat water when the tap is opened to permit the outflow of water, the heater being turned on to operate only when water flows out of the tap, and there is a second tap for the discharge of non-heated water, connected to said pipe up-stream of the heater.

* * * * *